US012618407B1

(12) United States Patent
Shaw

(10) Patent No.: US 12,618,407 B1
(45) Date of Patent: May 5, 2026

(54) CONNECTING RING OF A ROOT VACUUM PUMP

(71) Applicants: ELIVAC CO., LTD., Shanghai (CN); China Link Consultant Company, Ltd, Shanghai (CN); ELIVAC INC., Salisbury, MD (US)

(72) Inventor: Raymond Zhou Shaw, Shanghai (CN)

(73) Assignees: ELIVAC CO., LTD., Shanghai (CN); Ching Link Consultant Company, Ltd, Shanghai (CN); ELIVAC INC, Salisbury, MD (US)

( * ) Notice: Subject to any disclaimer, the term of this patent is extended or adjusted under 35 U.S.C. 154(b) by 0 days.

(21) Appl. No.: 19/228,798

(22) Filed: Jun. 5, 2025

(51) Int. Cl.
*F04C 27/00* (2006.01)
*F04C 18/12* (2006.01)
*F04C 25/02* (2006.01)

(52) U.S. Cl.
CPC ..... *F04C 27/008* (2013.01); *F04C 25/02* (2013.01); *F04C 18/126* (2013.01); *F04C 2240/30* (2013.01)

(58) Field of Classification Search
CPC ..... F04C 27/008; F04C 25/02; F04C 18/126; F04C 2240/30; F04C 2240/80; F02B 39/12; F02B 39/121
See application file for complete search history.

(56) References Cited

U.S. PATENT DOCUMENTS

| | | | | |
|---|---|---|---|---|
| 6,193,487 | B1 * | 2/2001 | Ni | F04C 27/005 418/141 |
| 6,821,099 | B2 * | 11/2004 | Wilk | F04C 2/3446 418/152 |
| 6,835,055 | B2 * | 12/2004 | Stellnert | F01C 21/104 418/265 |
| 8,784,084 | B2 * | 7/2014 | Hwang | F04C 2/3446 418/263 |
| 9,932,982 | B2 * | 4/2018 | Braasch | F04C 2/344 |
| 12,241,468 | B2 * | 3/2025 | Hattori | F04C 29/028 |
| 12,389,921 | B2 * | 8/2025 | Skoglund | A23C 9/16 |
| 2017/0284398 | A1 * | 10/2017 | Mitsuhashi | F04C 29/068 |
| 2021/0123345 | A1 * | 4/2021 | Moussa | F01C 1/16 |

* cited by examiner

*Primary Examiner* — Dapinder Singh

(57) ABSTRACT

A connecting ring of a root vacuum pump is provided. The connecting ring is installed in at least one end portion of a casing of a root vacuum pump for enlarging an effective volume of the casing. The connecting ring includes a frame having a hollow circular structure and being match to a shape of an end portion of the casing; a front end of the frame being formed with a front flange; a front end surface of the front flange and a rear end thereof being formed with a rear flange; and wherein an outer side of the frame is formed with a plurality of enhancing ribs which are formed between the end surfaces of the front flange and the rear flange; and a plurality of trenches are formed between the front flange, the rear flange and each enhance rib.

10 Claims, 6 Drawing Sheets

CONNECTING RING OF A ROOT VACUUM PUMP

FIELD OF THE INVENTION

The present invention relates to root vacuum pumps, and in particular to a connecting ring of a root vacuum pump.

BACKGROUND OF THE INVENTION

Root vacuum pumps are vacuum pumps without internal compression and are volume changed in rotation of the rotors. In the pump, a pair of rotors rotates synchronously along opposite directions without using oil sealing and lubrication is performed. Root vacuum pumps have the advantages of quick pumping speed, affectivity of volume usage, high vacuum, lower power consumption, compact structure, steadiness in operation with high reliability, etc. Therefore, root vacuum pumps are widely used in many fields, such as power, semiconductor, solar energy, oils and foods industrials, medicals, etc.

Due to different usages for root vacuum pumps, most of the root vacuum pumps are designed by cases, instead of by specifications. However, this will induce great labor and material necessity.

Pump bodies are based components of vacuum pumps. Pump bodies are manufactured integrally. The larger the volumes of the pump bodies, the difficulty the manufacturing works. Cost is the key concern for the market.

For reducing the cost for manufacturing of the root vacuum pump, the inventor of the present invention provides a connecting ring which can be connected to the pump body of a root vacuum pump for prolonging a length of the root vacuum pump so that the manufactures only need to design a specific pump body which can be connected with different sizes of connecting rings so as to form various different pump bodies with different sizes. As a result, the cost for manufacturing of root vacuum pumps is reduced greatly.

SUMMARY OF THE INVENTION

Accordingly, the object of the present invention is to provide a connecting ring of a root vacuum pump, wherein advantages of the present invention are that the connecting ring expands the volume of the root vacuum pump. By the assembly of the root vacuum pump with the connecting ring, it is formed with a novel root vacuum pump with various pumping size and vacuum ability for adapting the requirement of different specifications in the market. As a result, the root vacuum pumps can be produced by modules. This is beneficial for buying of the parts, installing the structure, quality control, and reduction of cost, etc.

To achieve above object, the present invention provides a connecting ring of a root vacuum pump, the connecting ring being installed in at least one end portion of a casing of a root vacuum pump for enlarging an effective volume of the casing, the connecting ring comprising: a frame having a hollow circular structure and being match to a shape of an end portion of the casing; a front end of the frame being formed with a front flange; a front end surface of the front flange and a rear end thereof being formed with a rear flange; and wherein an outer side of the frame is formed with a plurality of enhancing ribs which are formed between the end surfaces of the front flange and the rear flange; and a plurality of trenches are formed between the front flange, the rear flange and each enhance rib.

DETAILED DESCRIPTION OF THE INVENTION

In order that those skilled in the art can further understand the present invention, a description will be provided in the following in details. However, these descriptions and the appended drawings are only used to cause those skilled in the art to understand the objects, features, and characteristics of the present invention, but not to be used to confine the scope and spirit of the present invention defined in the appended claims.

Referring to FIGS. 1 to 6, the connecting ring for a root vacuum pump according to the present invention is illustrated. In assembly, the connecting ring 100 is installed in one end portion of a casing 2 of a root vacuum pump 1. The connecting ring 100 serves to expand an effective volume of the root vacuum pump 1. One end portion of the casing 2 of the root vacuum pump 1 is connected to the connecting ring 100. However, each of two end portions of the root vacuum pump 1 can be connected with a respective connecting ring 100. A length of the connecting ring 100 is designed as desired, a preferred one is 140 nm.

Figure 1:
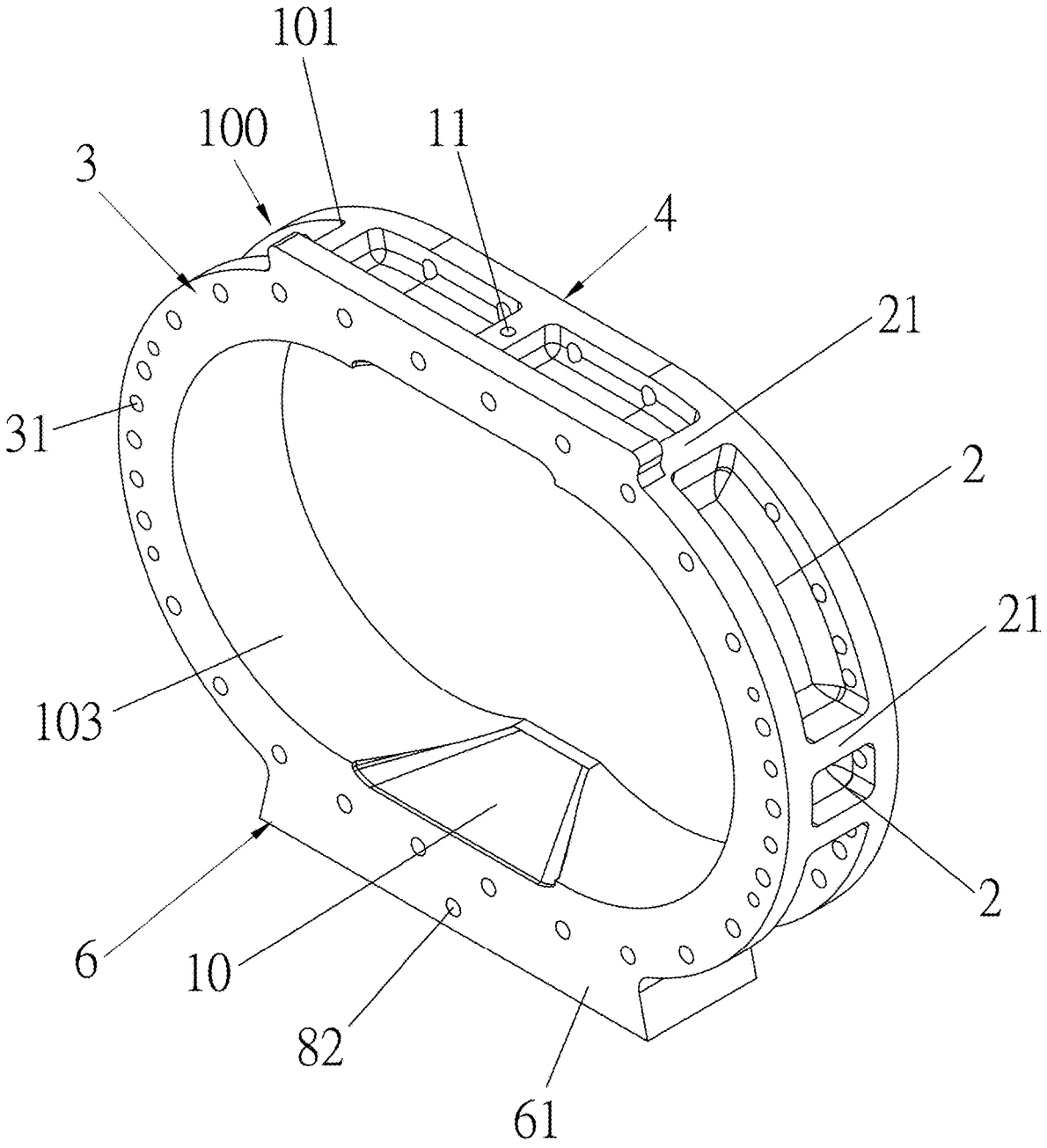
FIG. 1 is a front view of the connecting ring of the present invention.
Figure 2:
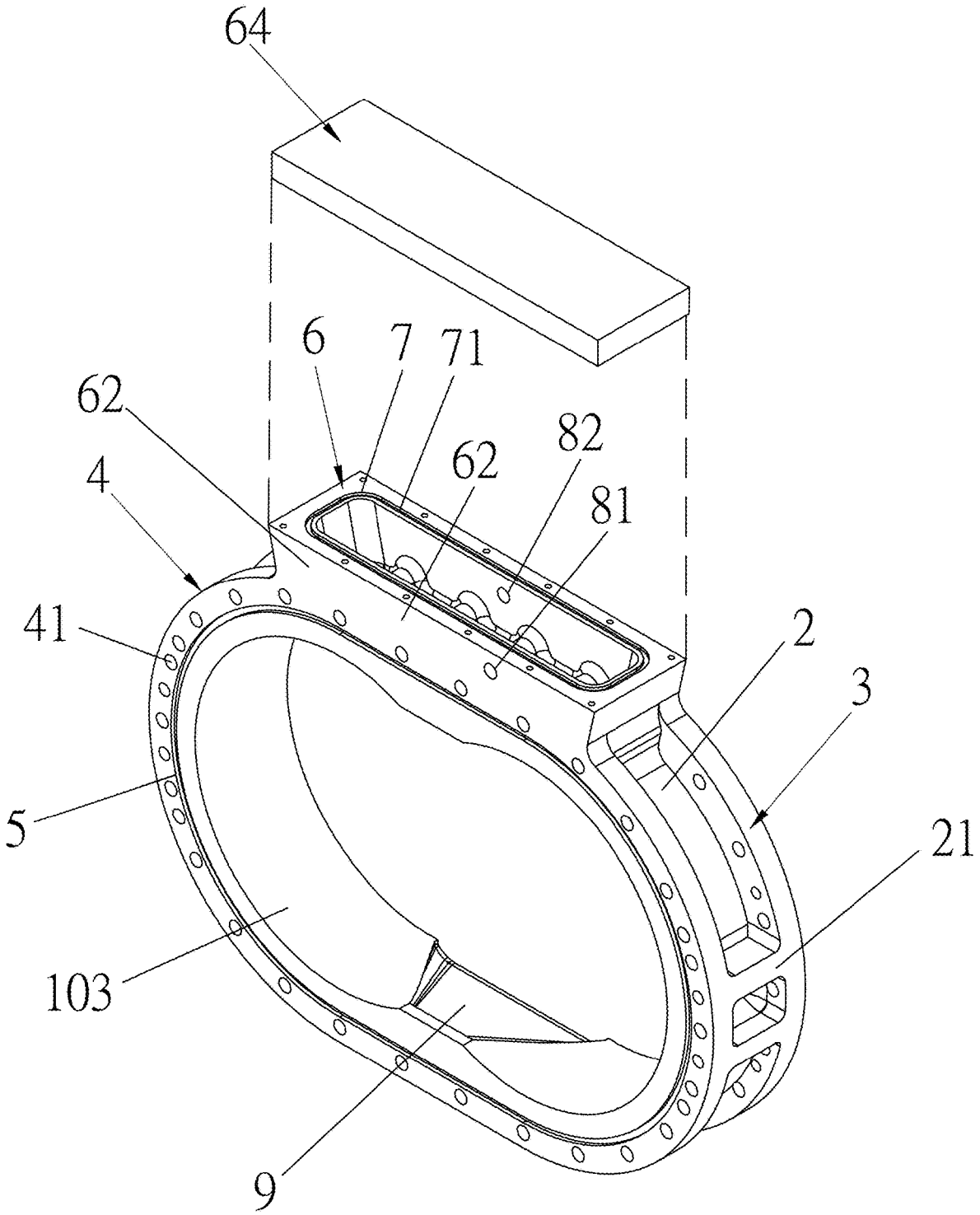
FIG. 2 is a rear view of the connecting ring of the present invention.
Figure 3:
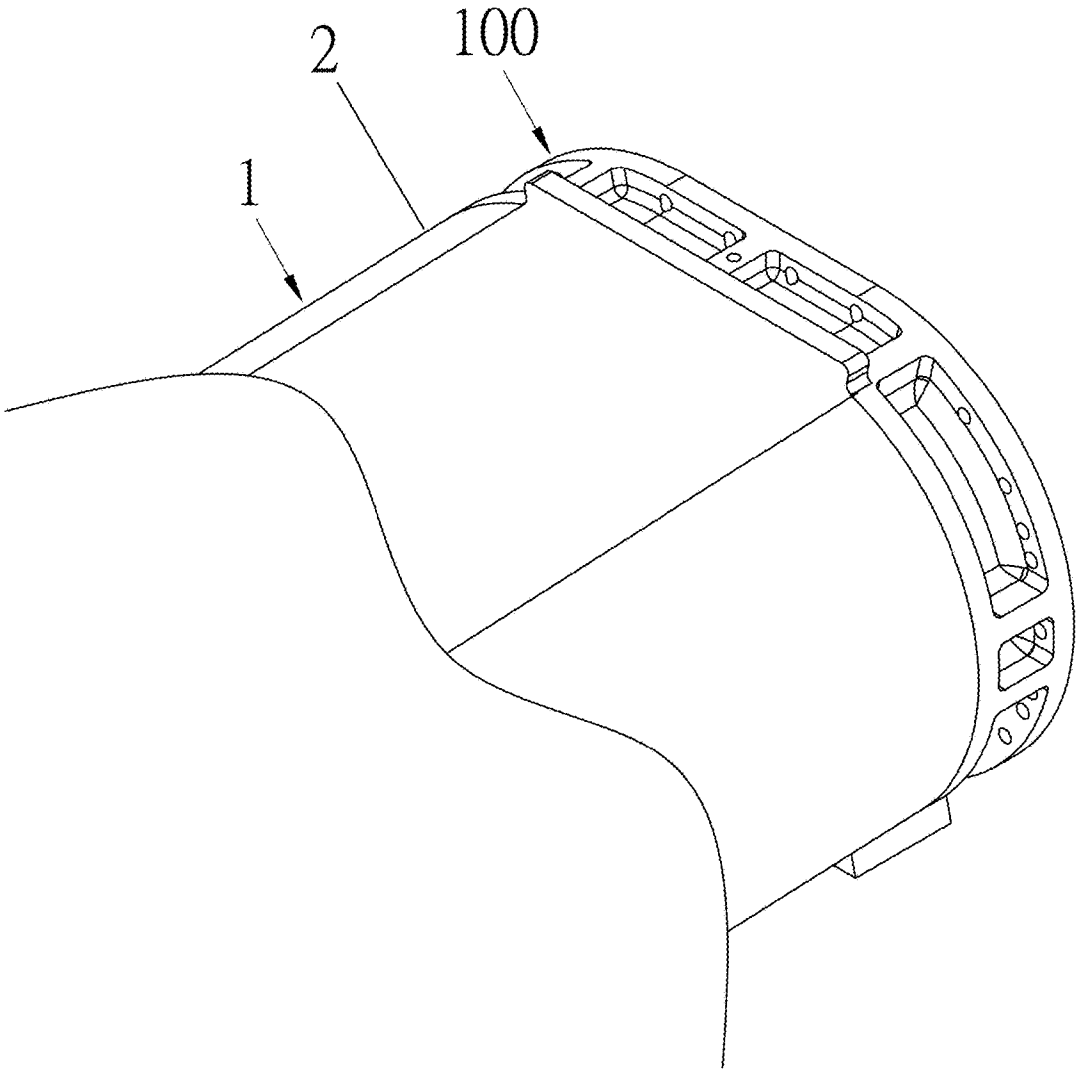
FIG. 3 is a perspective view showing the connection between the connecting ring and a root vacuum pump according to the present invention.

Referring to FIG. 1, the connecting ring 100 includes following elements.

A frame 101 has a hollow round structure and is match to the shape of the casing 2.

A front end of the frame 101 is formed with a front flange 3. A front end surface of the front flange 3 is formed with a plurality of screw holes 3. The front flange 3 is combined with the casing 2 of the root vacuum pump 1 (referring to FIG. 3). An inner diameter of the frame 101 is equal to that of the casing 2. Preferably, the inner diameter of the frame 101 is R=220 mm.

Figure 4:
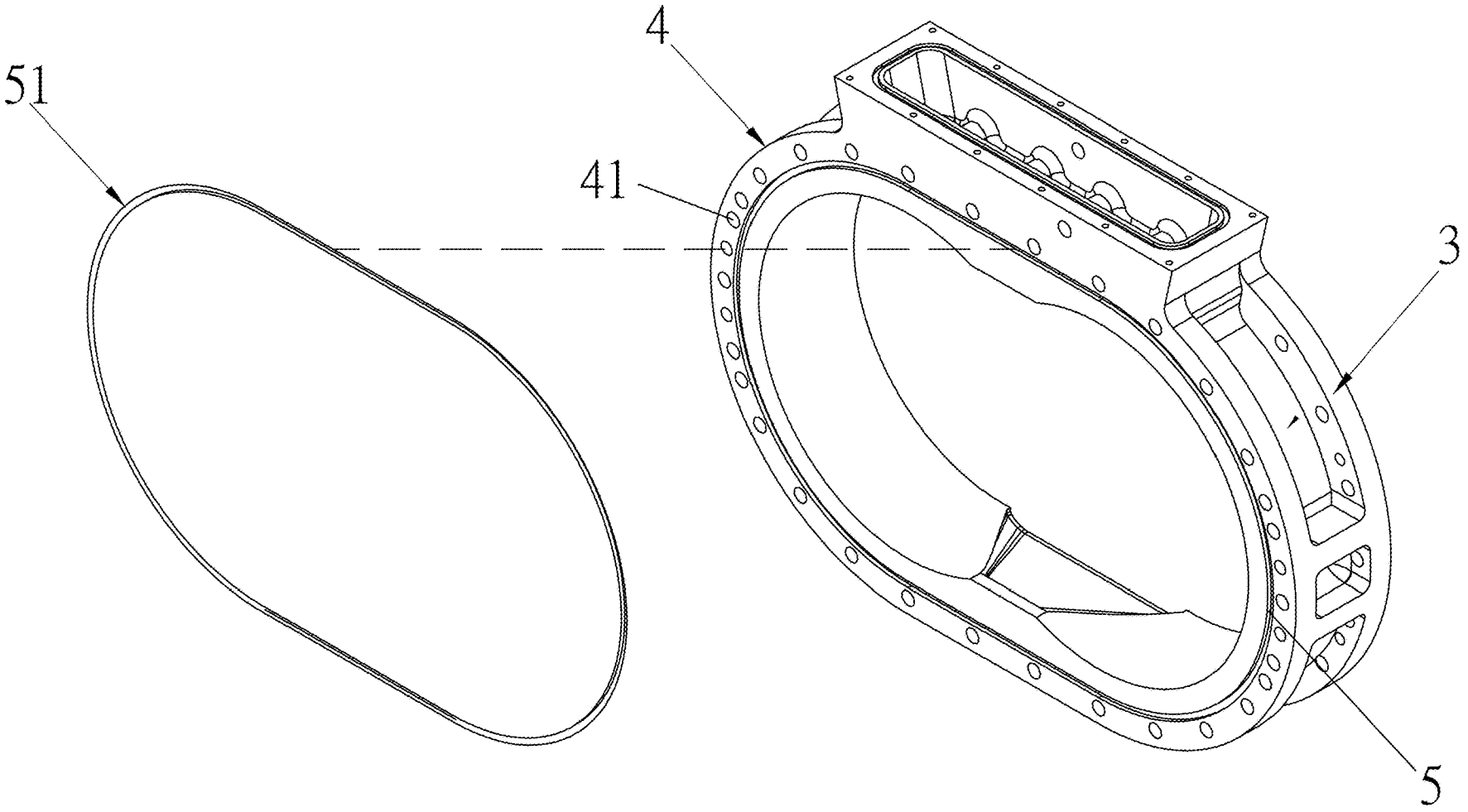
FIG. 4 is a schematic view showing the connection between the connecting ring and the first O ring according to the present invention.

A rear end of the frame 101 is formed with a rear flange 4. An end surface of the rear flange 4 is formed with a plurality of screw holes 41. As illustrated in FIG. 4, an end surface of the rear flange 4 is formed with a first O shape recess 5 which is formed at the surface having the screw holes 41 for installing a first O ring 51. With reference to the FIGS. 5 and 6, the end surface having the O shape recess 5 is combined with an end cover 200 for forming a tight sealing structure.

An outer side of the frame 101 is formed with a plurality of enhancing ribs 21 which are formed between the end surfaces of the front flange 3 and the rear flange 4. Each enhance rib 21 is parallel to an axis of the frame 101. Preferably, a width of the enhance rib 21 is 30 mm. A plurality of trenches are formed between the front flange 3, the rear flange 4 and each enhance rib 21. Preferably, a depth of each trench 2 is 48 mm.

The trenches 2 serve to reduce a weight of the connecting ring 100, and has the ability of increasing radiation and flow amount of the connecting ring 100.

A cooling chamber 6 is at a bottom of the frame 101. One front end surface 61 and one rear end surface 62 of the cooling chamber 6 are flushed with (as the same level as) two end surfaces of the rear flange 4. A left end surface and right end surface of the cooling chamber 6 are arranged across the front end surface 61 and rear end surface 62 of the cooling chamber 6.

A bottom surface of the cooling chamber 6 is formed with a second O shape recess 7 for installing a second O ring 71, wherein the front end surface 61 and rear end surface 62 of the cooling chamber 6 are formed with a cooling water outlets 82 and a cooling water inlet 81, respectively. In use, circulated cooling water is transferred into the cooling chamber 6 from the cooling water inlet 81 for cooling the connecting ring 100 for decreasing temperature in the root vacuum pump 1. A bottom of the cooling chamber 6 is covered with a sealing plate 64 for decreasing temperature in the root vacuum pump 1. Therefore, a complete sealing chamber for water cooling is achieved.

An inner wall 103 of the frame 101 is formed with an upper sloped flow guide surface 9 and a lower slopped flow guide surface 10. Preferably tilt angles of the upper sloped flow guide surface 9 and the lower slopped flow guide surface 10 with respect to the inner wall 103 are 17.3°.

In inner chamber of the root vacuum pump 1 has an air inlet and an air outlet. Two sides of the root vacuum pump 1 are installed with respective slit flow guide surfaces (not shown). The two flow guide surfaces are connected with the upper sloped flow guide surface 9 and the lower slopped flow guide surface 10. The upper sloped flow guide surface 9 causes that air from the air inlet of the root vacuum pump 1 flows along an axial direction of the blade shaft of the pump to two sides of the blades; and the lower sloped flow guide surface 10 causes that air in the chamber of the root vacuum pump 1 flows along an axial direction of the blade shaft of the pump to the air outlet of the root vacuum pump 1. Furthermore, in the process, cooling liquid flows out of the air outlet of the lower sloped flow guide surface 10.

Figure 5:
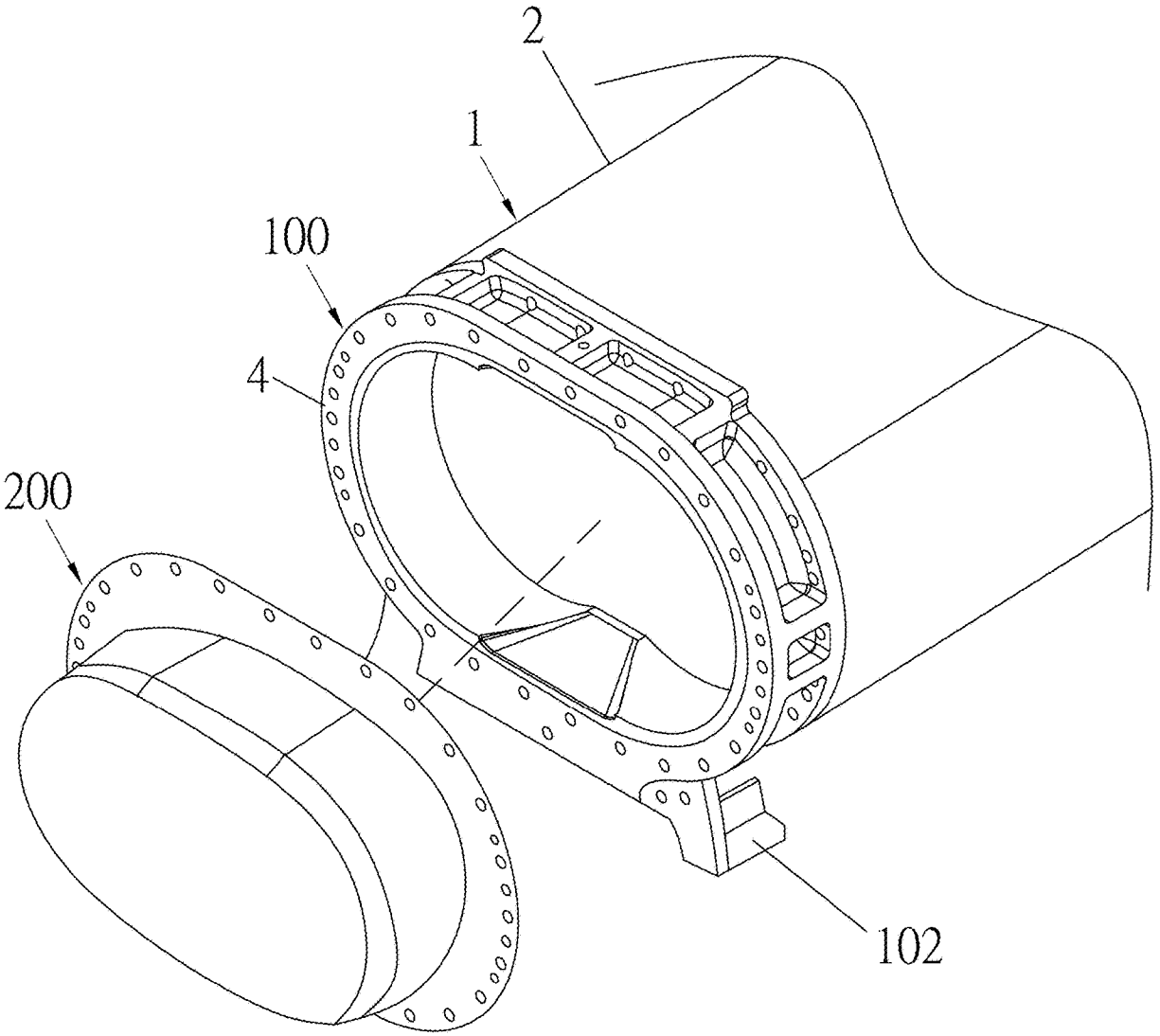
FIG. 5 is a schematic view showing the connection between the connecting ring and the end cover according to the present invention.
Figure 6:
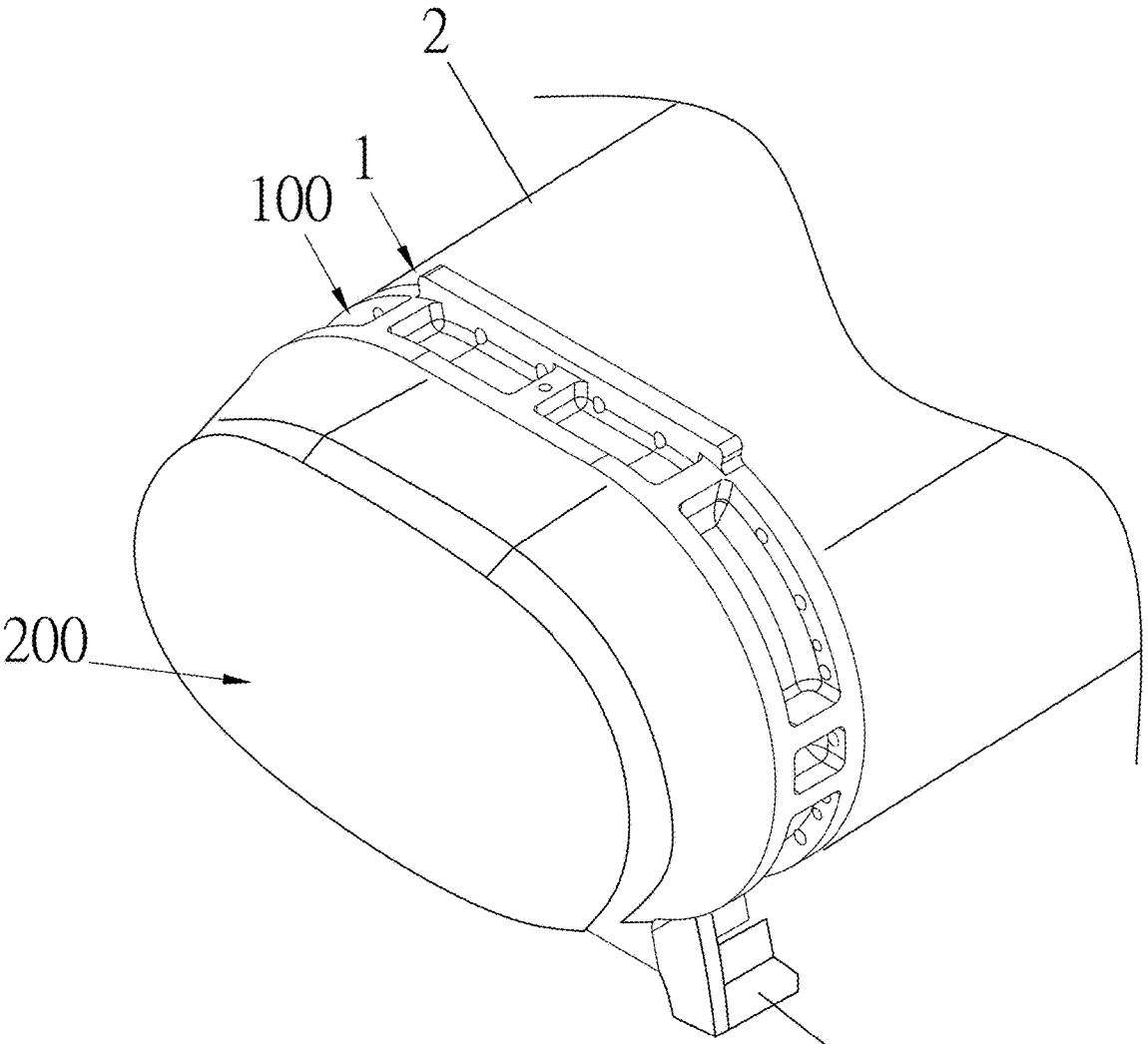
FIG. 6 shows an embodiment of the present invention.

In assembly, the rear flange 4 is combined with the end cover 200. As illustrated in FIG. 5, the plurality of M16 screws (not shown) pass through the ø18 thread holes in the end cover 200, the rear flange 4, and the front flange 3 to the screw holes in the casing 2 of the root vacuum pump 1. The connecting ring 100 and the root vacuum pump 1 are combined. Then the connecting ring 100 is not used, the end cover 200 is directly connected to the M16 screws in the casing 2 of the root vacuum pump 1.

A top side of the frame 101 is formed with at least one hanging screw hole 11 for hanging the connecting ring 100.

In assembly, the root vacuum pump 1 is assembled with the connecting ring 100. The two end covers 200 at two lateral sides are covered for formed as a chamber. Blades and supporting bearings are installed with the end covers 200.

A bottom of the frame 101 is installed with at least one pump leg 102. The end surface of the casing 2 of the root vacuum pump 1 is sealed by an O ring. An O shape recess is formed at an end surface of the root vacuum pump 1 (not shown). When the connecting ring 100 is not used, the end cover 200 is directly connected to the root vacuum pump 1 with the O ring to seal the gaps between the root vacuum pump 1 and the end covers.

Advantages of the present invention are that the connecting ring expands the volume of the root vacuum pump. By the assembly of the root vacuum pump with the connecting ring, it is formed with a novel root vacuum pump with various pumping size and vacuum ability for adapting the requirement of different specifications in the market. As a result, the root vacuum pumps can be produced by modules. This is beneficial for buying of the parts, installing the structure, quality control, and reduction of cost, etc.

The present invention is thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A connecting ring of a root vacuum pump, the connecting ring being installed in at least one end portion of a casing of a root vacuum pump for enlarging an effective volume of the casing, the connecting ring comprising:

a frame having a hollow circular structure and being match to a shape of an end portion of the casing; a front end of the frame being formed with a front flange; a front end surface of the front flange and a rear end thereof being formed with a rear flange; and wherein an outer side of the frame is formed with a plurality of enhancing ribs which are formed between the end surfaces of the front flange and the rear flange; and a plurality of trenches are formed between the front flange, the rear flange and each enhance rib.

2. The connecting ring of a root vacuum pump as claimed in claim 1, wherein a front end surface of the front flange is formed with a plurality of screw holes for combining the casing of the root vacuum pump.

3. The connecting ring of a root vacuum pump as claimed in claim 2, wherein an end surface of the rear flange is formed with a first O shape recess which is formed at the surface having the screw holes for installing a first O ring, in assembly, the end surface having the O shape recess is combined with an end cover for forming a tight sealing structure.

4. The connecting ring of a root vacuum pump as claimed in claim 3, wherein in assembly, the rear flange is combined with the end cover; the plurality of screws pass through thread holes in the end cover, the rear flange, and the front flange to the screw holes in the casing of the root vacuum pump; the connecting ring and the root vacuum pump are combined.

5. The connecting ring of a root vacuum pump as claimed in claim 1, wherein a bottom of the frame has a cooling chamber; a bottom of the cooling chamber is covered with a sealing plate, and thus, a complete sealing chamber for water cooling is achieved; and one front end surface and one rear end surface of the cooling chamber are flushed with two end surfaces of the rear flange; and a left end surface and a right end surface of the cooling chamber are arranged across the front end surface and rear end surface of the cooling chamber.

6. The connecting ring of a root vacuum pump as claimed in claim 5, wherein a bottom surface of the cooling chamber is formed with a second O shape recess for installing a second O ring, wherein the front end surface and rear end surface of the cooling chamber are formed with a cooling water outlets and a cooling water inlet, respectively.

7. The connecting ring of a root vacuum pump as claimed in claim 1, wherein an inner wall of the frame is formed with an upper sloped flow guide surface and a lower slopped flow guide surface.

8. The connecting ring of a root vacuum pump as claimed in claim 7, wherein a tilt angle of the upper sloped flow guide surface with respect to the inner wall and a tilt angle of the lower slopped flow guide surface with respect to the inner wall are 17.3°.

9. The connecting ring of a root vacuum pump as claimed in claim 1, wherein a top side of the frame is formed with at least one hanging screw hole for hanging the connecting ring.

10. The connecting ring of a root vacuum pump as claimed in claim 1, wherein a bottom of the frame is installed with at least one pump leg.

* * * * *